US009181009B1

(12) United States Patent
Buck

(10) Patent No.: US 9,181,009 B1
(45) Date of Patent: Nov. 10, 2015

(54) CUP WITH OUTWARDLY PROTRUDING STRAW CHANNEL AND NESTABLE FOOD CONTAINER AND COVER

(71) Applicant: TOP-THAT!, LLC, Encinitas, CA (US)

(72) Inventor: Ronald Mark Buck, Encinitas, CA (US)

(73) Assignee: SNACKTOPS, INC., Encinitas, CA (US)

( * ) Notice: Subject to any disclaimer, the term of this patent is extended or adjusted under 35 U.S.C. 154(b) by 0 days.

(21) Appl. No.: 14/279,512

(22) Filed: May 16, 2014

(51) Int. Cl.

| | |
|---|---|
| ***B65D 51/28*** | (2006.01) |
| ***B65D 21/02*** | (2006.01) |
| ***A47G 19/22*** | (2006.01) |
| ***A47G 21/18*** | (2006.01) |

(52) U.S. Cl.
CPC ..... *B65D 51/28* (2013.01); *A47G 19/2222* (2013.01); *A47G 19/2272* (2013.01); *A47G 21/18* (2013.01); *B65D 21/0228* (2013.01); *B65D 2203/00* (2013.01); *B65D 2231/022* (2013.01)

(58) Field of Classification Search
USPC ..... 220/23.83, 23.86, 23.87, 521–525, 575, 220/709, 710, 212, 669, 675; 206/214; 215/229, 388, 382, 383, 379; 426/119, 426/120, 85
See application file for complete search history.

(56) References Cited

U.S. PATENT DOCUMENTS

| | | | | |
|---|---|---|---|---|
| 1,665,289 | A | | 4/1928 | Weaver |
| 3,288,344 | A | * | 11/1966 | Woollen et al. ..... 229/103.1 |
| 3,323,706 | A | | 6/1967 | Gereke |
| 3,413,128 | A | | 11/1968 | Steinbarth et al. |
| 3,421,654 | A | | 1/1969 | Hexel |
| 3,679,089 | A | | 7/1972 | Swett et al. |
| 4,054,205 | A | | 10/1977 | Blow, Jr. et al. |
| 4,074,827 | A | | 2/1978 | Labe, III |
| 4,091,953 | A | | 5/1978 | Daenen |
| 4,627,537 | A | | 12/1986 | Rogers |
| 4,699,299 | A | | 10/1987 | Gach |
| 5,145,646 | A | | 9/1992 | Tyranski |
| 5,283,140 | A | | 2/1994 | Netz et al. |

(Continued)

FOREIGN PATENT DOCUMENTS

| | | |
|---|---|---|
| EP | 1397986 | 3/2004 |
| RU | 2118281 C1 | 8/1998 |
| WO | 2012033472 | 3/2012 |

OTHER PUBLICATIONS

International Search Report and Written Opinion issued for PCT Appl. No. PCT/US2014/010181, dated Apr. 24, 2014, 7 pages.

(Continued)

*Primary Examiner* — Jeffrey Allen
*Assistant Examiner* — Jennifer Castriotta
(74) *Attorney, Agent, or Firm* — Manuel de la Cerra; Joseph J. Mayo

(57) ABSTRACT

A cup with an outwardly protruding straw channel and nestable food container and cover that enables simultaneous or intermittent access of the contents of the container and attached cup without disengagement of the food container from the cup, wherein a portion of the cup that holds the food container may be utilized as a fill line when filling liquids into the cup to ensure that insertion of the food container does not result in overflow of liquid from the cup. Additionally, the food container may include at least one cavity that may hold at least one independent drop-in container. A simple domed cover or variable height domed cover may keep food items that are placed within the food container warm.

27 Claims, 10 Drawing Sheets

(56) References Cited

U.S. PATENT DOCUMENTS

| | | | | |
|---|---|---|---|---|
| 5,318,787 | A | 6/1994 | Brauner | |
| 5,310,072 | A | 10/1994 | Matusovsky et al. | |
| 5,388,729 | A * | 2/1995 | Gerringer | 222/130 |
| 5,503,858 | A | 4/1996 | Reskow | |
| 5,624,053 | A | 4/1997 | Freek et al. | |
| 5,720,555 | A | 2/1998 | Elele | |
| 5,743,423 | A | 4/1998 | Franco | |
| D397,911 | S | 9/1998 | Waldmann | |
| 5,954,195 | A | 9/1999 | Krueger et al. | |
| 6,085,919 | A | 7/2000 | Singer | |
| 6,119,884 | A | 9/2000 | Lowry | |
| 6,164,485 | A | 12/2000 | Hilton | |
| 6,299,014 | B1 | 10/2001 | Nava et al. | |
| 6,338,417 | B1 | 1/2002 | Ferraro | |
| 6,412,526 | B2 | 7/2002 | Castillo | |
| 6,425,480 | B1 | 7/2002 | Krueger et al. | |
| 6,528,105 | B1 | 3/2003 | Gerhart et al. | |
| 6,706,297 | B1 | 3/2004 | Toth et al. | |
| 6,793,075 | B1 | 9/2004 | Jeter | |
| 7,063,229 | B2 | 6/2006 | Westerhof et al. | |
| 7,111,748 | B2 | 9/2006 | Cha | |
| 7,159,732 | B2 | 1/2007 | Smith et al. | |
| 7,217,434 | B1 | 5/2007 | Loh et al. | |
| 7,387,063 | B2 | 6/2008 | Vu et al. | |
| 7,588,275 | B2 | 9/2009 | Borg | |
| 7,594,584 | B2 | 9/2009 | Durdon et al. | |
| 7,721,911 | B2 | 5/2010 | Chou | |
| D635,855 | S | 4/2011 | Smith et al. | |
| D637,079 | S | 5/2011 | Brown et al. | |
| 8,006,854 | B2 | 8/2011 | Waugh | |
| 2002/0110622 | A1 * | 8/2002 | Lloyd et al. | 426/115 |
| 2003/0173237 | A1 * | 9/2003 | Kim | 206/217 |
| 2003/0178433 | A1 | 9/2003 | Adams | |
| 2004/0050724 | A1 | 3/2004 | Grul | |
| 2004/0089662 | A1 | 5/2004 | Smith et al. | |
| 2005/0035011 | A1 | 2/2005 | McRobbie | |
| 2005/0115845 | A1 | 6/2005 | Cho | |
| 2005/0178688 | A1 | 8/2005 | Hasson | |
| 2005/0205437 | A1 | 9/2005 | Huffman et al. | |
| 2006/0060589 | A1 | 3/2006 | Lee | |
| 2006/0096983 | A1 | 5/2006 | Patterson | |
| 2007/0029322 | A1 | 2/2007 | Durdon et al. | |
| 2008/0099481 | A1 | 5/2008 | D'Amato | |
| 2008/0230541 | A1 | 9/2008 | Bayss et al. | |
| 2009/0065377 | A1 | 3/2009 | Olomi et al. | |
| 2009/0250479 | A1 | 10/2009 | Kaufman et al. | |
| 2009/0272390 | A1 | 11/2009 | Blondeel | |
| 2011/0210126 | A1 * | 9/2011 | Vovan | 220/574 |
| 2011/0248033 | A1 | 10/2011 | Mehrvijeh | |
| 2011/0266295 | A1 | 11/2011 | Yacktman | |
| 2011/0309093 | A1 | 12/2011 | Buck | |
| 2012/0061409 | A1 * | 3/2012 | Fioritto et al. | 220/708 |
| 2013/0171303 | A1 * | 7/2013 | Larsen et al. | 426/120 |

OTHER PUBLICATIONS

International Search Report Dated Mar. 19, 2013, 14 pages.

International Preliminary Report on Patentability and Written Opinion received for PCT Application No. PCT/US2012/054032, dated Mar. 20, 2014, 10 pages.

International Search Report and Written Opinion issued for PCT Appl. No. PCT/US2013/070630, dated Mar. 13, 2014, 6 pages.

International Search Report and Written Opinion issued for PCT Appl. No. PCT/US2013/070632, dated Mar. 13, 2014, 6 pages.

International Search Report and Written Opinion issued on Jul. 11, 2014 in PCT/US2013/029188.

International Preliminary Report on Patentability issued Sep. 18, 2014 in PCT/US2013/029188.

Prodekspo-2012: TM "Zelenaya Sova"—razdelnaya upakovka dlya napitkov, Feb. 16, 2012, [online], [retrieved on Feb. 11, 2013). Retrieved from the Internet <URL: http://news.unipackru/38718/#comments.

International Preliminary Report on Patentability issued Jul. 16, 2015 in PCT/US2014/010181.

International Preliminary Report on Patentability issued Mar. 20, 2014 in PCT/US2012/054032.

International Preliminary Report on Patentability issued May 28, 2015 in PCT/US2013/070630.

International Preliminary Report on Patentability issued May 28, 2015 in PCT/US2013/070632.

* cited by examiner

CUP WITH OUTWARDLY PROTRUDING STRAW CHANNEL AND NESTABLE FOOD CONTAINER AND COVER

BACKGROUND OF THE INVENTION

1. Field of the Invention

One or more embodiments of the invention are related to the field of containers. More particularly, but not by way of limitation, one or more embodiments of the invention include a cup with an outwardly protruding straw channel and nestable food container and cover that enables simultaneous or intermittent access of the contents of the food container and attached cup without disengagement of the food container from the cup. Embodiments may include a cover that encloses the food container, for example a dome cover that for example snaps closed on an inner portion of the food container. Furthermore, according to one or more embodiments, the cup includes an outer corner portion or ledge configured as a fill line when filling liquids into the cup, to ensure that the insertion of the food container does not result in overflow of liquid from the cup. The outer corner portion or ledge that implements the fill line may also provide support for a portion of the food container. Alternatively, or in combination, the food container and cup may include at least one horizontal step wall, strength rib or other narrowing structure that may also provide support for the food container within the cup.

2. Description of the Related Art

Standard cup lids are simple covers that do not include an integrated food container. Rather, known lids cover the contents of a cup wherein the lid forms a closed container in combination with the cup itself. Known containers that couple with cups include food containers that fit onto the top of yogurt cups for example. These containers typically have to be removed from the yogurt cup and then flipped over and opened before the contents of the container and cup may be accessed. It is generally not possible to access the contents of the cup while also accessing the contents of the container without first disengaging the container from the cup. Additionally, food containers that attach to yogurt cups, for example, in an upside-down position have a limited food-volume capacity. In such cases, as the yogurt example shows, the food-container walls narrow as they proceed upward toward the bottom of the upside down container. Other known devices having a container or shelf combined with a lid have limitations, which makes these devices impractical to use.

One category of devices typically includes a container combined with a cup, but utilizes a straw hole in the middle of the lid. This makes it generally impossible to store relatively circular items, i.e., non-ring or non-annular items having no central hole, in the container, such as hamburgers, cookies or muffins for example. Another category of device typically includes a container combined with a lid, but does not allow for simultaneous access of the contents of the cup and the container, and does not allow for the container to be resealed or a drop-in seated container to be inserted and removed from the food container. Other containers that form portions of the lid have limitations in the amount of storage or shape of the storage area, which limits the quantity or type of food respectively.

Typically, cups include a straw hole located on a top horizontal portion of the cup or a lid/cover of the cup, but generally do not allow for a straw to protrude outwardly from a vertical sidewall of a body or portion of the cup. Furthermore, generally, round cups, such as plastic cups, include a rolled top edge that adds structure and strength to the top portion of a standard drinking cup. However, in such round plastic cups, typically, it is difficult to roll the top edge of a drink cup or container when complex or irregular shapes are formed at the top edge of the cup. Generally, rolled top edge cups or containers limits the use of more complex and unique shapes for an upper body of the cup or container, and limits the use of non-standard shapes for one or more food items in the container.

Thus simultaneous or intermittent access of the contents of known cups and of the contents of an attached container is not practical for at least the reasons listed above. This makes for difficult drinking/eating coffee, soda, snacks, popcorn, etc., in malls, fast food restaurants, theaters, amusement parks, and sports stadiums or in any other venue. In addition, this makes it difficult to eat and drink food in a theater or stadium with one cup-holder per seat, and makes it difficult to simultaneously access solids and liquids using a plurality of containers and container cavities, without disengaging the containers/cavities.

Thick walled, reusable food/drink containers have been developed but utilize a relatively large amount of plastic compared to a thin wall injection molded container. Skillfully engineered, thin film thermoformed or thin wall injection molded disposable containers have not been developed for the fast food and convenience store industries. Thin film thermoforming and thin wall injection molding are typically the two most cost efficient manufacturing methods for producing high volume parts. According to industry standards, thin film or thin wall construction is defined in the approximate range of 0.010 to 0.030.

Typically, thin film thermoforming and thin wall injection molding are specific manufacturing sciences that demand precise engineering and highly accurate tolerances. Strategic strength features or elements that stabilize the structural integrity of the cups and containers, generally, must be incorporated into the construction of thin wall parts. Without strength elements, thin wall parts generally become flimsy and lose their ability to precisely mate with one another. Typically, thin film thermoforming requires drafts on all parts such that the parts may release from their prospective molds. When it comes to thin film or thin wall construction, every detail is important. Without precise engineering, for example, thin wall parts may lack structural integrity and these parts may lose their ability to precisely fit together.

For at least the limitations described above there is a need for a cup with an outwardly protruding straw channel that includes a nestable food container and cover.

BRIEF SUMMARY OF THE INVENTION

One or more embodiments described in the specification are related to a cup with an outwardly protruding straw channel and nestable food container and cover. In at least one embodiment of the invention, the food container includes at least one wall that defines at least one container body, wherein the at least one container body stores food including a first solid or liquid.

According to at least one embodiment, the cup includes a substantially vertical sidewall, an outwardly protruding straw channel integrated in the substantially vertical sidewall, and a recessed opening. In at least one embodiment, the recessed opening may lie or reside in an annular plane on top of the cup. In one or more embodiments, the substantially vertical sidewall includes a lower cup body, and an upper cup body having a portion that is wider than the lower cup body. In at least one embodiment, the portion that is wider in the upper cup body with respect to the lower cup body defines a fill line, wherein the fill line may indicate a volume of beverage to fill in the cup. The cup keeps a second solid or liquid such as a beverage for example separate from the first solid or liquid stored in the food container. In at least one embodiment, the container body contacts the first solid or liquid on one side and the second solid or liquid on an opposing side of the at least one wall. The outer corner portion or ledge of the upper cup body that forms the fill line may also be utilized as a support for the food container. Alternatively, or in combination, the food container and cup may include at least one horizontal step wall, strength rib or other narrowing structure that may also provide support for the food container within the cup.

By way of one or more embodiments, the upper cup body holds the food container, and the at least one container body may descend into the recessed opening of the cup down into the portion that is wider in the upper cup body with respect to the lower cup body, for example downward to the portion that defines the fill line. In at least one embodiment, the upper cup body may include an outwardly extending area, and the at least one container body may include a corresponding outwardly extending area to enable the fingers of a user to access the food in the at least one container body.

In one or more embodiments, the food container may include a plurality of downward oriented container cavities, and each of the plurality of downward oriented cavities include a bottom outer portion, such as, but not limited to a corner portion. In one or more embodiments, the plurality of downward oriented container cavities may vary in one or more of size, shape and depth. In at least one embodiment, the corner portion may be utilized with a portion of the cup for example to support the food container. In at least one embodiment, at least one of the plurality of downward oriented container cavities may rest on the outer corner portion or ledge that is wider in the upper cup body and the outer corner portion may act to define the fill line of the cup.

According to at least one embodiment, the food container includes at least one cover, such as a single cover or a plurality of covers, to enclose the food container. In one or more embodiments, the at least one container body may include a container body vertical wall, and the at least one cover may include a cover vertical wall and a snap close element in the cover vertical wall and the container body vertical wall, wherein the container body vertical wall, the cover vertical wall and the snap close elements securely hold the at least one cover closed. In at least one embodiment, the food container and the at least one cover may be configured as a one-piece clam shell construction, or may be separate elements. In one or more embodiments, the plurality of covers may vary in one or more of height and shape. In one or more embodiments, the at least one cover may include a grip handle and at least one vent hole. The at least one vent hole, in at least one embodiment, may prevent condensation from building up within the at least one cover and the at least one container body.

According to at least one embodiment, the substantially vertical sidewall of the cup may include at least one horizontal step wall or strength rib element integrated into the upper cup body. In one or more embodiments, the at least one cover may include at least one horizontal step wall or strength rib element integrated into the lower sidewall region of the at least one cover. These elements provide strength to the thin wall implementations. In at least one embodiment, the at least one container body may include an upward protruding male post, for example to implement a press fit element to fixedly hold a condiment container with a corresponding female press fit element.

By way of one or more embodiments, the at least one cover may be a variable height cover, such as a variable height domed cover, that may be replaceable, and may include a raised portion to accommodate tall food items. In at least one embodiment, the raised portion may be used as a grip handle for removing the cover. In one or more embodiments, there may be an additional raised portion adjacent to the raised portion that accommodates a tall food item that may act as a clip/trough element to hold at least one item. At least one raised portion in the top horizontal wall of the cover may comprise a clip/trough element.

According to at least one embodiment of the invention, the at least one cover may include an outer edge and at least one horizontally oriented flexible flange/lip located at the outer edge. In one or more embodiments, the at least one container may include at least one male snap/bump element. As such, in at least one embodiment, the at least one horizontally oriented flexible flange/lip may snap over or past the at least one male snap/bump element.

In at least one embodiment, the at least one container body may include an outer continuous or non-continuous edge, such as an outer horizontal edge. In one or more embodiments, the outer edge may include an outer vertically oriented receiving wall, such that the outer vertically oriented receiving wall accepts the at least one horizontally oriented flexible flange/lip.

By way of at least one embodiment, the at least one container body may include at least one horizontally oriented lift tab, such as two crescent shaped lift tabs, for example, integrated into the outer edge of the at least one container body. In one or more embodiments, the horizontally oriented crescent shaped lift tabs are configured to facilitate lifting of the at least one container body from the upper cup body.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A cup with an outwardly protruding straw channel and a nestable food container and cover will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
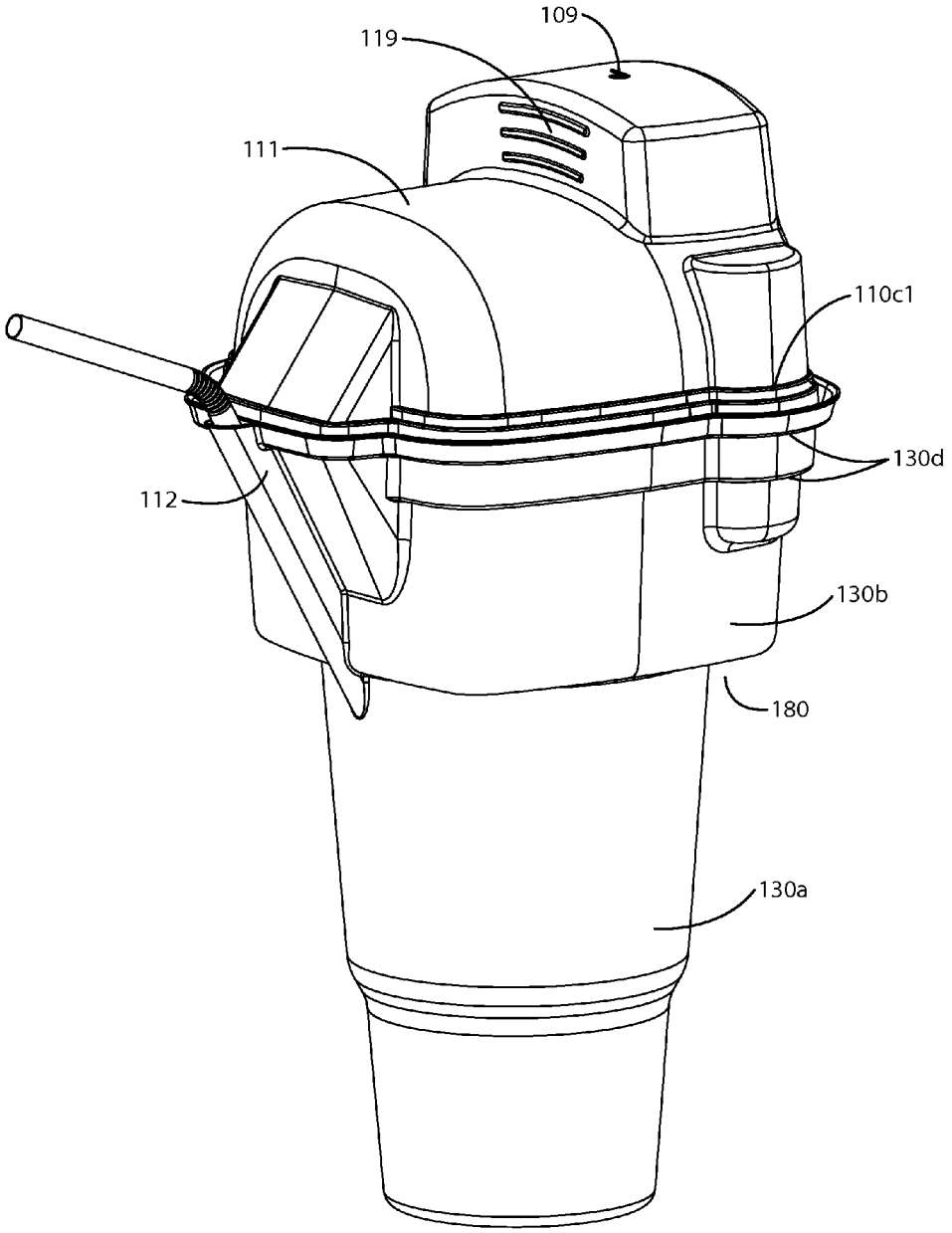
FIG. 1 illustrates a perspective view of an embodiment of the invention.

FIG. 1 illustrates a perspective view of an embodiment of the invention. As shown, one or more embodiments described in the specification are related to a cup with an outwardly protruding straw channel 112 and a nestable food container 131 (see FIG. 2) and cover 111. In at least one embodiment of the invention, the food container includes at least one wall that defines at least one container body 131 (see FIG. 2), wherein the at least one container body stores food including a first solid or liquid. Embodiments of the food container for example may include one or more cavities, for example a plurality of cavities, for example to hold a burger and french fries. As shown, in one or more embodiments of the invention, at least one cover 111 may be utilized to enclose the food container and the cover may include at least one cover vent hole 109 and at least one cover grip handle 119 in one or more embodiments.

Figure 7:
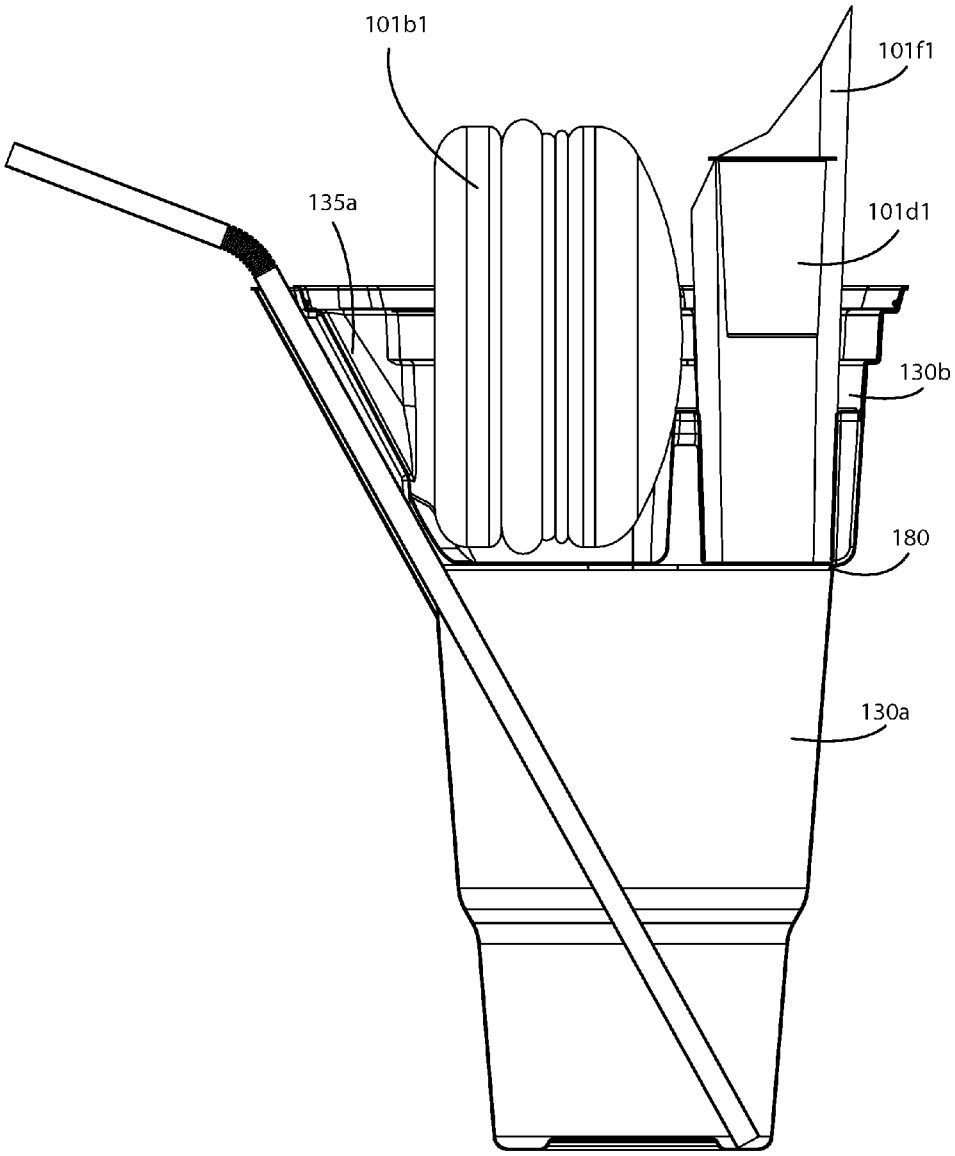
FIG. 7 illustrates a side cutaway view of an embodiment of the invention with the cover removed.
Figure 8:
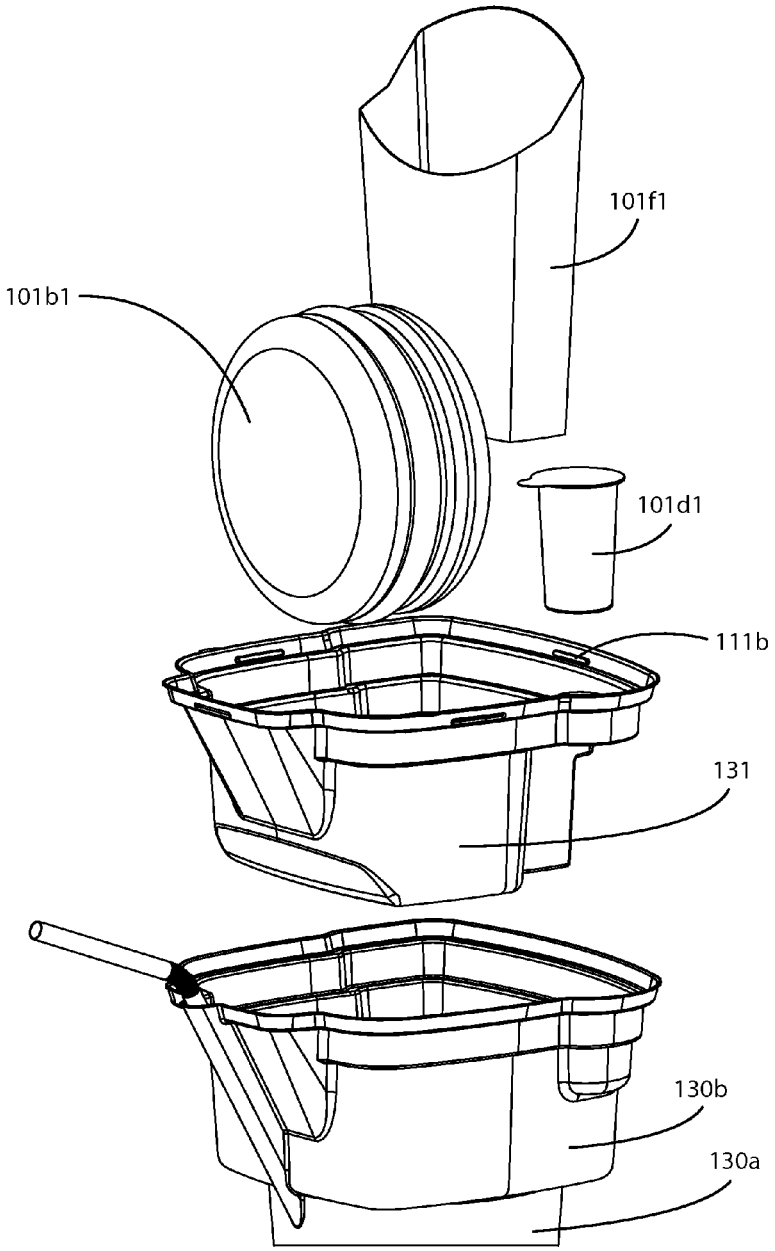
FIG. 8 illustrates an exploded perspective view of an embodiment of the invention with the cover removed.

According to at least one embodiment, the cup includes a substantially vertical sidewall, an outwardly protruding straw channel 112 integrated in the substantially vertical sidewall, and a recessed opening (see FIGS. 7 and 8). In at least one embodiment, the recessed opening may lie or reside in an annular plane on top of the cup. In one or more embodiments, the substantially vertical sidewall includes a lower cup body 130*a*, and an upper cup body 130*b* having a portion that is wider than the lower cup body 130*a*. In one or more embodiments of the invention, the upper cup body 130*b* may be of any shape or size, such as round, square, octagonal or a combination thereof, to accommodate unique shapes and sizes of one or more solids or liquids. By way of at least one embodiment, the upper cup body 130*b* may include a top surface that is implemented as a molded edge and/or is thermoformed, such that the upper cup body 130*b* may include at least one downward oriented half round, three-quarter round, or inverted and downward facing trough. In at least one embodiment, the at least one trough may be open and may include a three-walled square trough or a rectangular trough.

In at least one embodiment, the outwardly protruding straw channel 112 may receive a straw, such that the straw may be inserted into the upper cup body 130*b* and the lower cup body 130*a*.

In at least one embodiment, the outer corner portion that is wider in the upper cup body 130*b* with respect to the lower cup body 130*a* defines a fill line 180, wherein the fill line may indicate a volume of beverage to fill in the cup. The cup keeps a second solid or liquid such as a beverage for example separate from the first solid or liquid stored in the food container. As such, the second solid or liquid may be filled up to a top most portion of the lower cup body, below or at the outer corner portion of the upper cup body 130*b*. In other words, according to at least one embodiment, a user stops filling the cup with the second solid or liquid at the point where the outer corner portion, or the upper cup body 130*b* meets the substantially vertical sidewall of the lower cup body 130*a*. The portion of the upper cup body 130*b* that forms the fill line 180 may also be utilized as a support for the food container. By way of at least one embodiment, the outwardly protruding straw channel 112 may extend into or be integrated with a substantially vertical sidewall of the lower cup body 130*a*.

In at least one embodiment, the container body 131 (see FIG. 2) contacts the first solid or liquid on one side and the second solid or liquid on an opposing side of the at least one wall. In one or more embodiments, the at least one cover 111 may include at least one horizontal step wall or strength rib elements 110*c*1, and the at least one container body 131 may include at least one horizontal step wall or strength rib cup elements 130*d*. By way of one or more embodiments, the at least one horizontal step wall elements or strength rib elements may be continuous or non-continuous, and may travel around an entire distance of an upper sidewall that forms the outer shape of the upper cup body 130*b* and the at least one container body 131. In at least one embodiment, the at least one horizontal step wall or strength rib cup elements 130*d* may be integrated in an upper sidewall region of the upper cup body 130*b*, and may act as mating elements that seat or engage the at least one horizontal step wall or strength rib elements 130*d* in the substantially vertical sidewall of the at least one container body 131. Thus in one or more embodiments the at least one container body 131 may be supported by the at least one horizontal step wall or strength rib elements 130*d* in the upper cup body 130*b*. Alternatively, or in combination, the fill line outer corner portion, for example of any shape, may support the at least one container alone or in combination with the at least one horizontal step wall or strength rib cup elements 130*d* in the upper cup body 130*b*.

According to at least one embodiment, the at least one cover 111 may comprise a single cover or may include a plurality of covers to enclose at least a portion of the food container 131. In one or more embodiments, the at least one cover 111 may include one or more of an interior and exterior press-on or snap-on cover.

Figure 2:
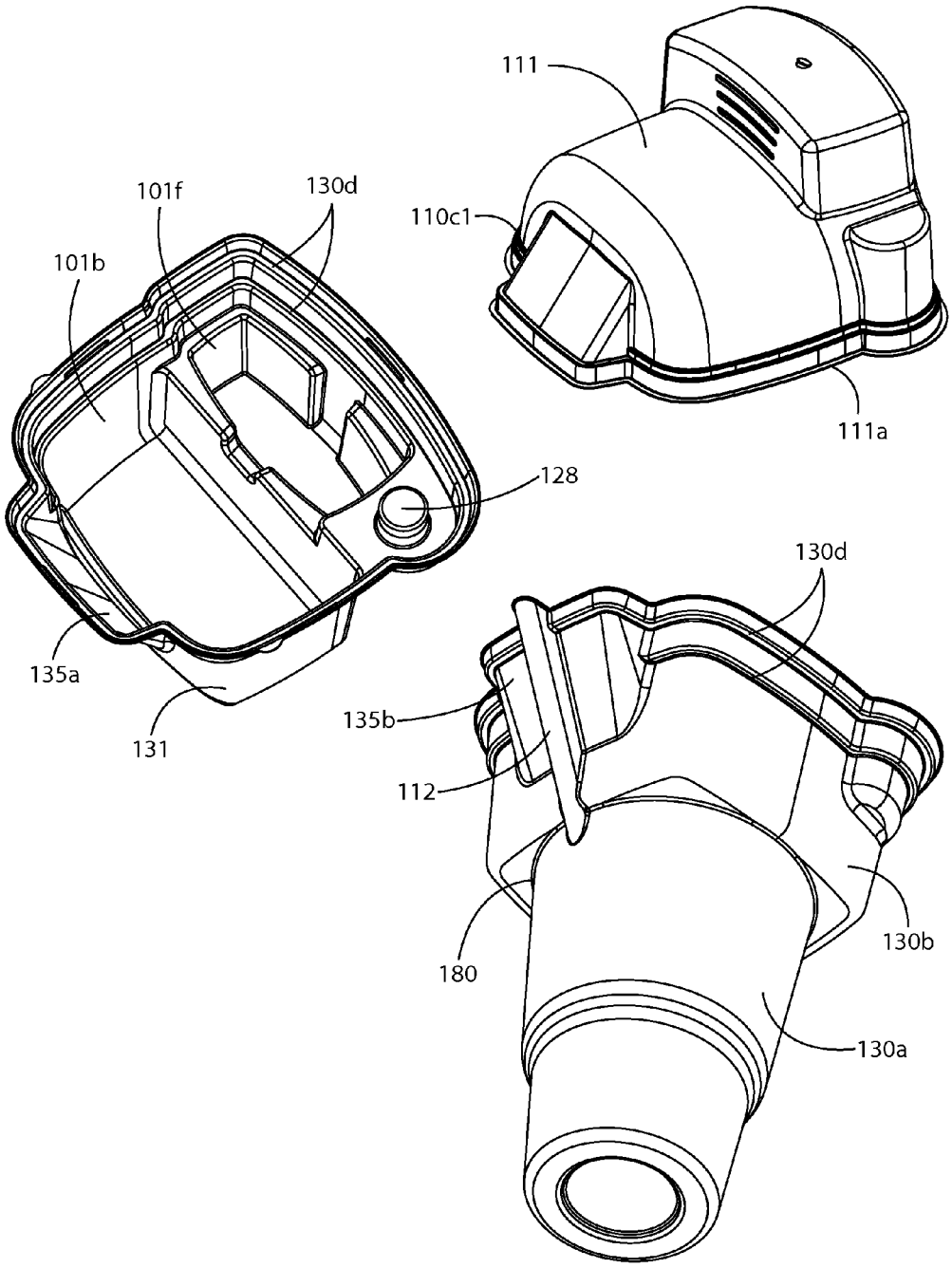
FIG. 2 illustrates an exploded view of the three main components that comprise an embodiment of the cup with outwardly protruding straw channel and nestable food container and cover.
Figure 2A:
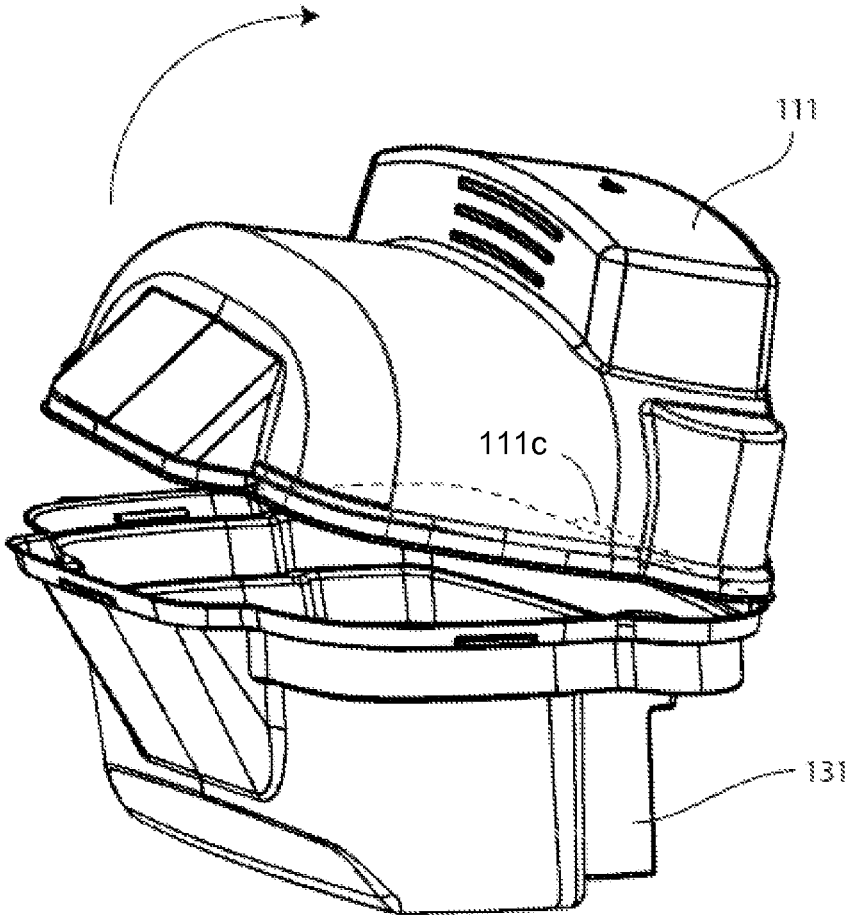
FIG. 2A illustrates a perspective view of a clamshell construction an embodiment of the invention.

In at least one embodiment, the food container 131 and the at least one cover 111 may be a one-piece element, for example a clamshell construction shown in FIG. 2A that employs a hinge 111c, or may be separate elements as shown in FIG. 2. In one or more embodiments, the plurality of covers may vary in one or more of height and shape. The at least one vent hole 109, in at least one embodiment, may prevent condensation from building up within the at least one cover 111 and the at least one container body 131. According to one or more embodiments, the at least one vent hole 109 may be located on a top surface wall of the at least one cover 111. As such, in at least one embodiment, when steam from, for example, a hot beverage, builds up on the inside of the at least one container body 131 and at least one cover 111, condensed water drops are prevented that would otherwise drip downward from the interior of the at least one cover 111, which would result in food items becoming soft or soggy.

FIG. 2 illustrates an exploded view of the three main components that comprise an embodiment of the cup with outwardly protruding straw channel and nestable food container and cover. By way of one or more embodiments, the upper cup body 130*b* holds the food container, and the at least one container body 131 may descend into the recessed opening of the cup down into the portion that is wider in the upper cup body 130*b* with respect to the lower cup body 130*a*. In at least one embodiment, the food container includes an outwardly extending area 135*a* that enables a user to access the contents of cavity 101*b*. In addition, the upper cup body 130*b* may include an outwardly extending cup area 135*b* that corresponds to outwardly extending area 135*a*. In at least one embodiment of the invention, the at least one container body includes a top surface with a horizontal wall, that for example may provide extra strength in addition to providing a divider or dividing wall or walls for separate food items.

As shown in FIG. 2, in one or more embodiments of the invention, the food container may include a plurality of downward oriented container cavities 101*b* and 101*f*, and each of the plurality of downward oriented cavities 101*b* and 101*f* include a bottom outer portion, such as a corner portion. In one or more embodiments, the plurality of downward oriented container cavities may vary in one or more of size, shape and depth. In at least one embodiment, the corner portion of the at least one container cavity may be utilized with a continuous or non-continuous outer corner portion of the cup for example to support the food container. In at least one embodiment, at least one of the plurality of downward oriented container cavities 101*b* and 101*f* may rest on the outer corner portion or ledge that is wider in the upper cup body 130*b* and the outer corner portion may act to define the fill line 180 of the cup. As such, in at least one embodiment, the outer corner portion of the at least one container body 131 may rest upon a continuous or non-continuous outer corner portion that is integrated into the lower region of the substantially vertical sidewall of the upper cup body 130*b*. According to one or more embodiments, the at least one container body 131 may include a plurality of container bodies, 101*b* and 101*f*.

In one or more embodiments, the at least one container body 131 may include an outer edge vertical wall, and the at least one cover 111 may include a outer edge horizontal or vertical lip or flange and additionally there may be at least one snap close element in the outer edge vertical wall of the container body, wherein the outer edge horizontal or vertical lip or flange of the cover and the at least one snap close element securely hold the at least one cover 111 closed. According to at least one embodiment, the substantially vertical sidewall of the cup may include the at least one horizontal step wall or strength rib elements 130*d* integrated into the upper cup body 130*b*. In one or more embodiments, the at least one cover 111 may include the at least one horizontal step wall or strength rib elements 100*c*1 integrated into the lower sidewall region of the at least one cover. In at least one embodiment, the at least one container body 131 may include a single container body or a plurality of container bodies, and may include one or more of at least one dividing wall, and at least one female downward press-fit cavity 101*f* and at least one upward protruding male post 128. In one or more embodiments, the at least one cover 111 may include at least one horizontally oriented flexible flange/lip 111*a* (as will be discussed further below).

In at least one embodiment, the at least one horizontal step wall elements or strength rib elements 110*c*1 and 130*d* may be intermittent or interrupted, and/or may occur in any shape such as small half dome or half circle indents that project outwardly from the substantially vertical sidewall, and are strategically placed at spaced intervals around each of the sidewall regions of the at least one cover 111 and the upper body 130*b*.

Figure 3:
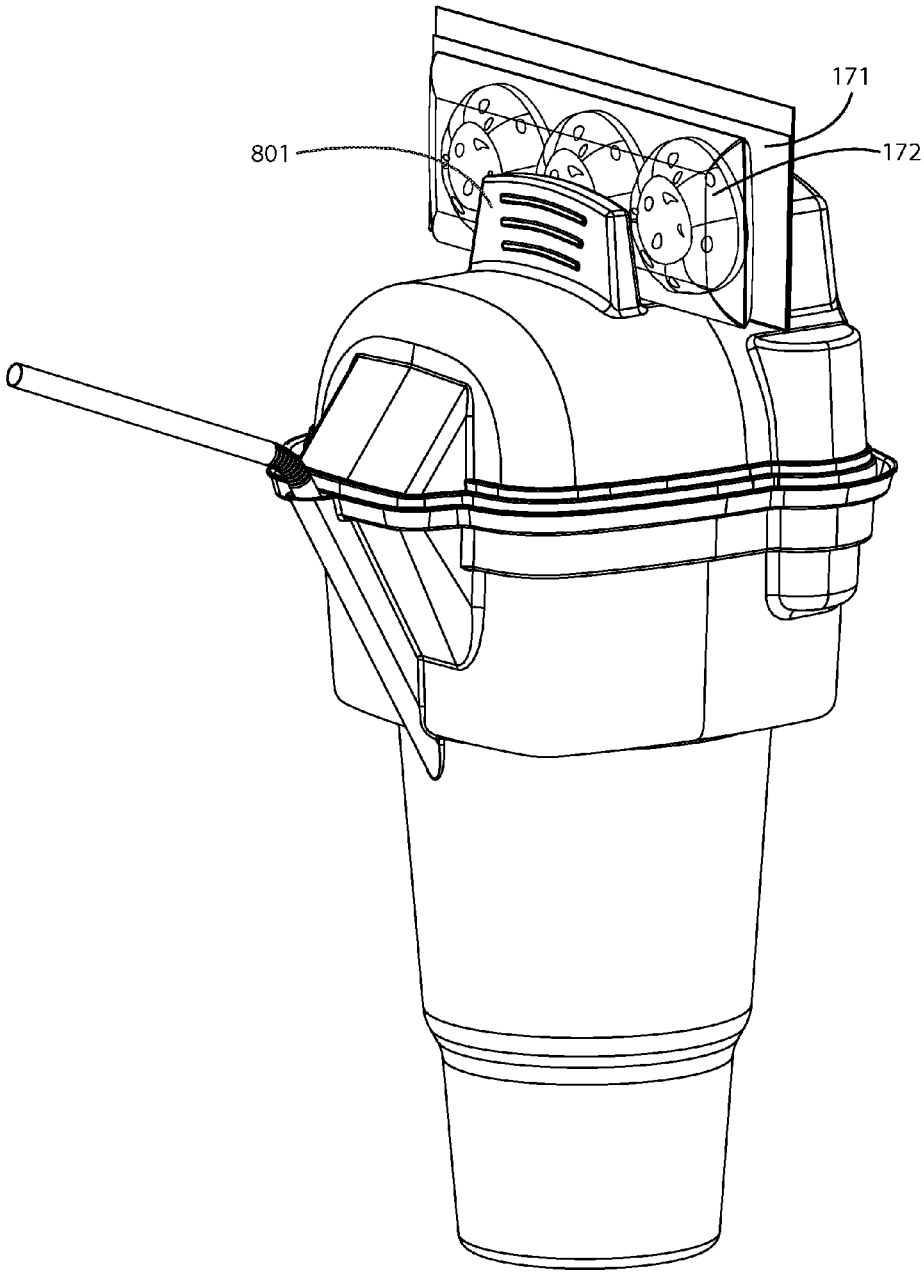
FIG. 3 illustrates a perspective view of a second embodiment of the cover.

FIG. 3 illustrates a perspective view of a second embodiment of the cover. By way of one or more embodiments, the at least one cover 111 may be a variable height cover, such as a variable height domed cover, that may be replaceable, and may include a raised portion. In at least one embodiment, the at least one cover 111 may be a simple domed shaped cover. As shown, in at least one embodiment, the raised portion, or any other portion of the at least one cover 111, may include a grip handle 119. In at least one embodiment, the raised portion and/or the grip handle 119 facilitate the removal and attachment of the at least one cover 111 from and to the at least one container body 131. In one or more embodiments, the raised portion allows for a wider variety of foods of various heights to be placed within the food container, while ensuring the food remains warm. According to at least one embodiment, the at least one cover 111 may be variable in height to conform to tall food items located within the at least one container body 131. The at least one cover 111, may include at least one clip/trough element 801 located adjacent to the raised portion that accommodates all food items, wherein the clip/trough element 801 holds at least one item, such as at least one napkin 171, at least one cookie, such as at least one cookie within a bag 172 and other items that may be placed within the clip/trough element 801 with or without a bag or cover. As such, in one or more embodiments, the at least one clip/trough element 801 allows for the at least one item to remain tightly in place during use of the food and container and during any type of movement, ensuring the at least one item is securely held. In at least one embodiment, the at least one clip/trough element 801 may be located on any side or portion of the at least one cover, and alone or in combination with the raised portion and may act as a grip handle in addition to, or instead of, the at least one grip handle 119.

According to at least one embodiment of the invention, the cup may include an insulation layer that may float on top of the second solid or liquid, or for example may be otherwise placed on or integrated with any surface of 101*b* or 101*f*, such as at the bottom interior portion of 101*b* and 101*f*. In at least one embodiment, the bottom interior portion of cavity 101*b* and 101*f* may include a cardboard or absorbent pad or padding material, in addition to or instead of the floating insulation layer. In one more embodiments, the cardboard or absorbent pad or padding material may be placed directly on a bottom horizontal wall of at least one of the plurality of downward oriented cavities. For example, the floating insulation layer may be useful when the second solid or liquid may include a cold item. In one or more embodiments, the floating insulation layer may be a substantially circular layer that may be die-cut in any fashion to accommodate the insertion of a straw through the insulation layer. In at least one embodiment, the floating insulation layer may be die-cut from a thin sheet of closed cell foam or bubble-wrap, or any other water-resistant insulative material. In one or more embodiments, the insulation layer and/or the cardboard or absorbent pad or padding material may absorb one or more fluids such as water, sauce and/or liquid associated with food, such as juice, and may be placed under one or more solid or liquid items.

Figure 4:
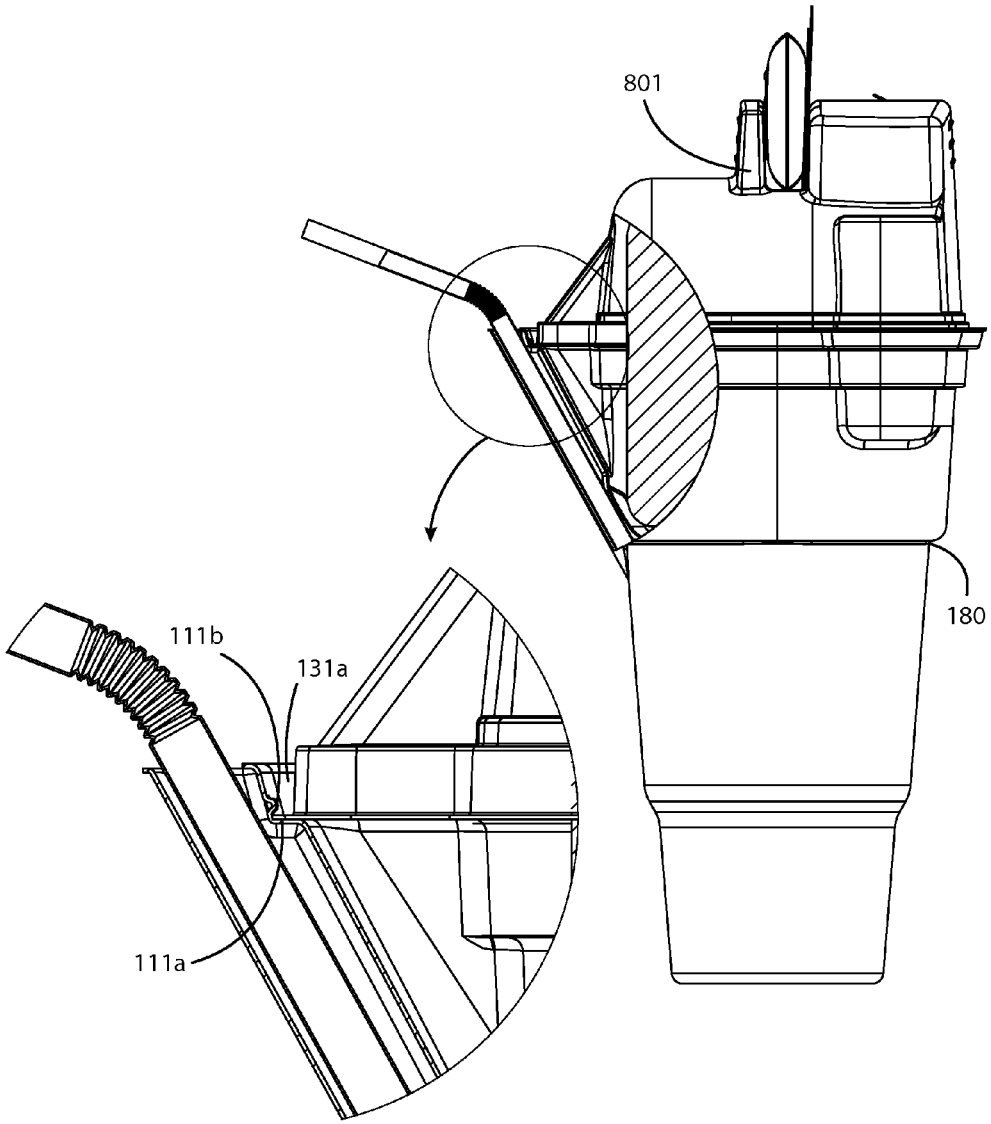
FIG. 4 illustrates a side view and close-up view of an embodiment of the invention with the second configuration of the cover.

FIG. 4 illustrates a side view and close-up view of an embodiment of the invention. According to at least one embodiment of the invention, the at least one food container 131 may include an outer edge that may for example be configured as a vertically oriented receiving wall 131*a* that receives the horizontally oriented flexible flange/lip 111*a* of cover 111, wherein the bottom portion of the flexible flange/lip rests on a flat portion of the food container near the outer edge. In one or more embodiments, the at least one container 131 may include at least one male snap/bump element 111*b*. As such, in at least one embodiment, the at least one horizontally oriented flexible flange/lip 111*a* on the cover may snap over or past the at least one male snap/bump element 111*b* on the container. Embodiments thus enable the at least one cover 111 to be easily attached and removed from the at least one container body 131.

Figure 5:
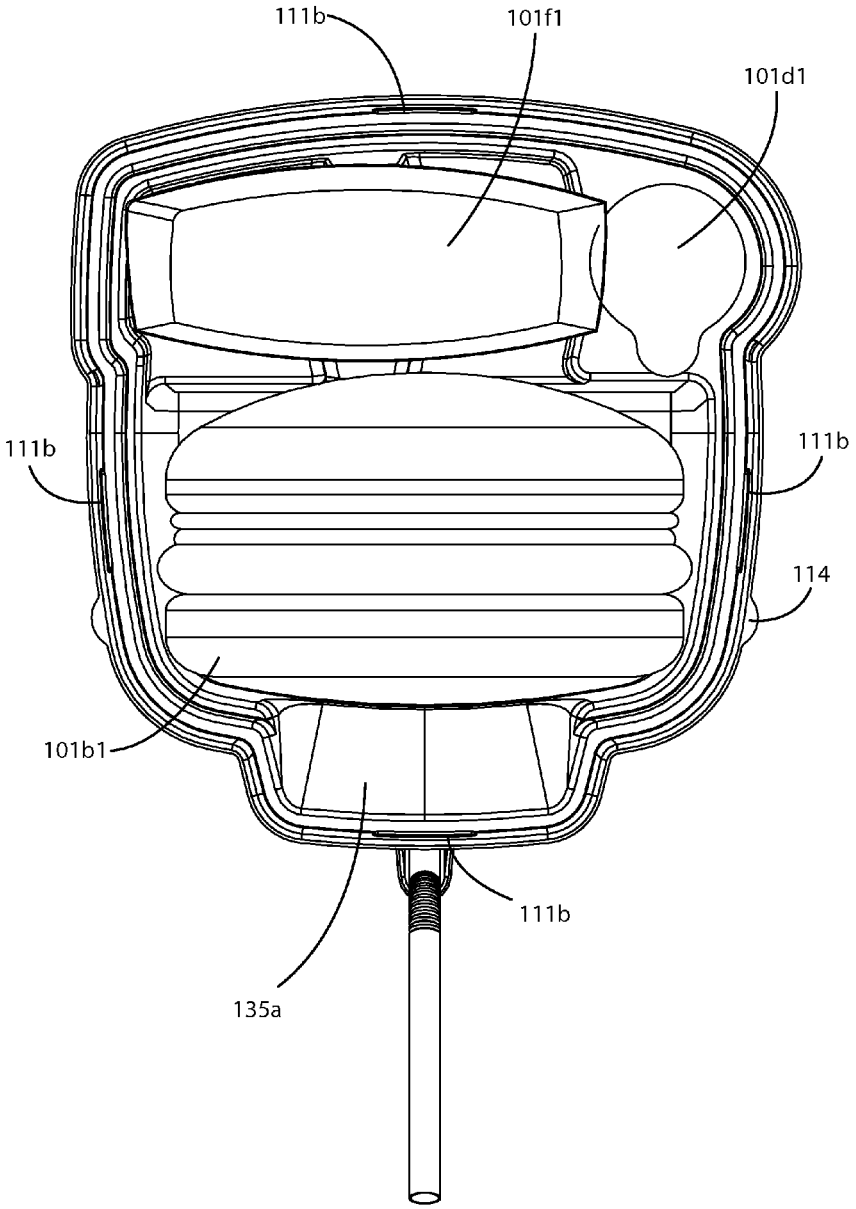
FIG. 5 illustrates a top view of an embodiment of the invention with the cover removed, for example with a burger, cardboard french fry container and dipping sauce cup.
Figure 6:
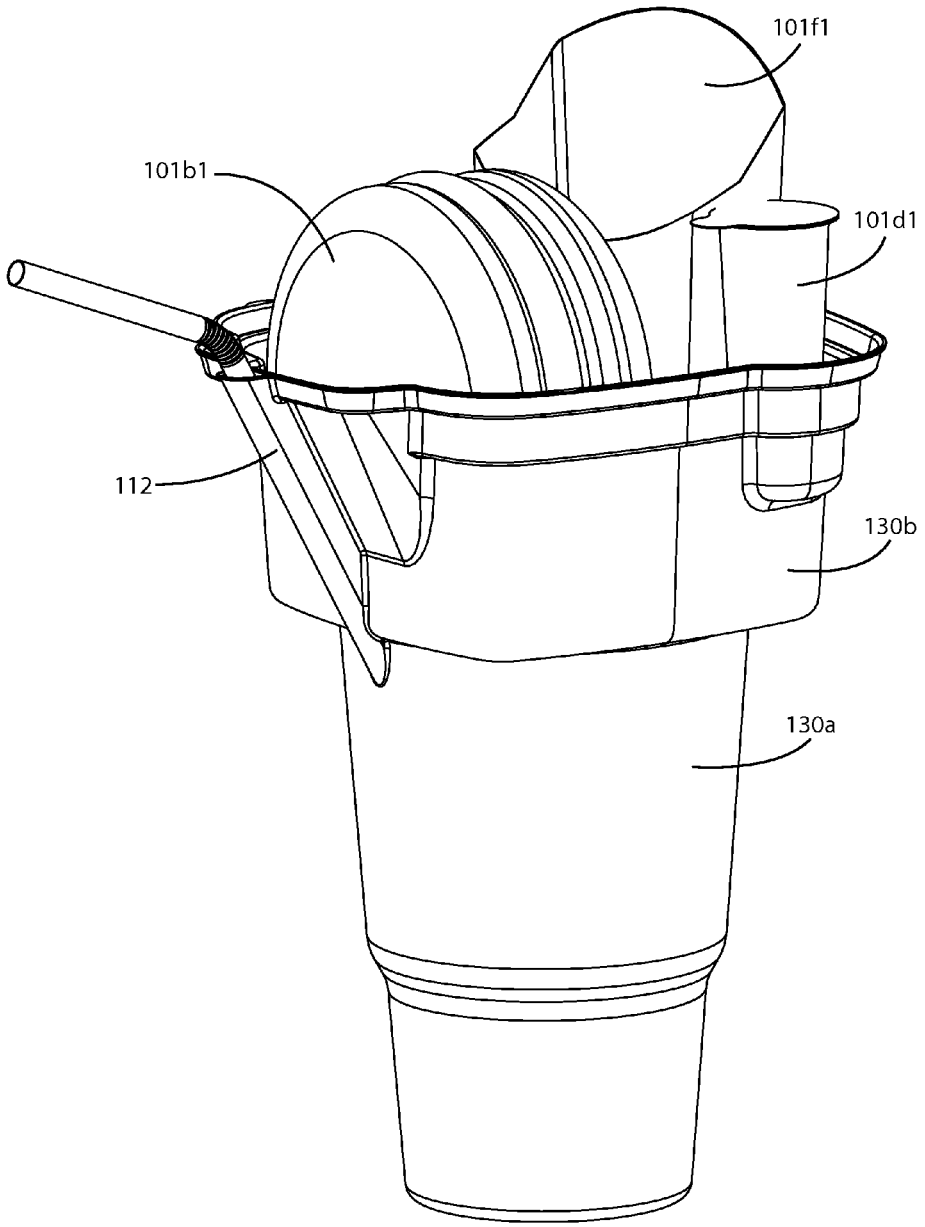
FIG. 6 illustrates a perspective view of an embodiment of the invention with the cover removed.

FIG. 5 illustrates a top view of an embodiment of the invention with the cover removed, and FIG. 6 illustrates a perspective view of an embodiment of the invention with the cover removed. By way of at least one embodiment, the container may include at least one horizontally oriented lift tab 114, integrated into the outer lip of the at least one container body 131. In one or more embodiments, the at least one horizontally oriented lift tabs 114 may be crescent shaped lift tab, or any other shape as may be required by other embodiments of the invention. In one or more embodiments, the horizontally oriented lift tabs 114 facilitate lifting of the at least one container body 131 from the upper cup body 130*b*, and for example allows the lower cup body 130*a* to be refilled with a beverage after removing the container from the cup.

In at least one embodiment, the at least one male snap/bump elements 111*b* may be integrated into an inner surface of the at least one container body 131, such as in an inner surface of the outer edge lip area. The at least one male snap/bump elements 111*b*, in at least one embodiment, may be continuous or non-continuous elements, such that the at least one horizontally oriented flexible flange/lip 111*a* may slide past and snap over the at least one male snap/bump elements 111*b*. In at least one embodiment, the at least one male snap/bump elements 111*b* may include a linear or non-linear row of dots. In one or more embodiment, the plurality of downward oriented container cavities 101*b* and 101*f* may be recessed cavities that tightly hold at least one independent drop in container, such as a cardboard french fry container for example. In one or more embodiments, the plurality of downward oriented container cavities 101*b* and 101*f* may form a downward volume that conforms to the bottom shape, or full shape, of a drop-in container such as a cardboard french fry container or condiment container. As such, in one or more embodiments, the first solid or liquid items may be press-fit with a downward push into the recessed downward oriented container cavities 101*b* and 101*f*, wherein the downward oriented container cavities 101*b* and 101*f* may include, or be of, a reasonably similar or exact shape and size of the first solid or liquid items, respectively. Alternatively or in combination the bottom portions of any drop-in containers may mate with press fit elements such as an upward protruding male post 128 as shown in FIG. 2.

In at least one embodiment, the outwardly extending cup area 135*b* (FIG. 2) and the outwardly extending container area 135*a* may be located adjacent to the outwardly protruding straw channel 112, located at a front portion (in relation to the user and straw) of the upper cup body 130*b*. In one or more embodiments, the outwardly extending cup area 135*b* may be integrated with the outwardly protruding straw channel 112 and the upper cup body 130*b*. In one or more embodiments, the straw does not interfere with the outwardly extending cup area 135*b* and the outwardly extending container area 135*a* that enable a user to grab and access the solids or foods in the at least one container body 131.

FIG. 7 illustrates a side view of an embodiment of the invention with the cover removed and FIG. 8 illustrates an exploded perspective view of an embodiment of the invention with the cover removed. In at least one embodiment, the first solid or liquid items 101*b*1, 101*f*1 and 101*d*1 may be placed in one or more respective cavities of the plurality of downward oriented cavities 101*b* and 101*f*, or on upward protruding male circular post 128 respectively, wherein each of the first solid or liquid items may be placed side by side and/or may be stacked on top of one another. In at least one embodiment, each of the first solid or liquid items 101*b*1, 101*f*1 and 101*d*1 may be placed at a front portion, back portion, middle portion or any combination thereof, of the at least one container body 131. In one or more embodiments, one or more of the first solid or liquid items, such as 101*b*1, 101*f*1 and 101*d*1, may rest on the outer corner portion, of the plurality of downward oriented cavities 101*b* and 101*f*, at the fill line 180. As shown in FIG. 8, in at least one embodiment, one or more of the solid or liquid items 101*b*1, 101*f*1 and 101*d*1 may be placed within the at least one container body 131, and the at least one container body 131 may be placed within the cup through the recessed opening defined by the top planar opening shown in the cup. According to one or more embodiments, the at least one container body may include at least one divided wall to compartmentalize the first solid or liquid items. In at least one embodiment, each of the first solid or liquid items, such as 101*b*1, 101*f*1 and 101*d*1, may be placed at equal heights, or at variable heights.

Figure 9:
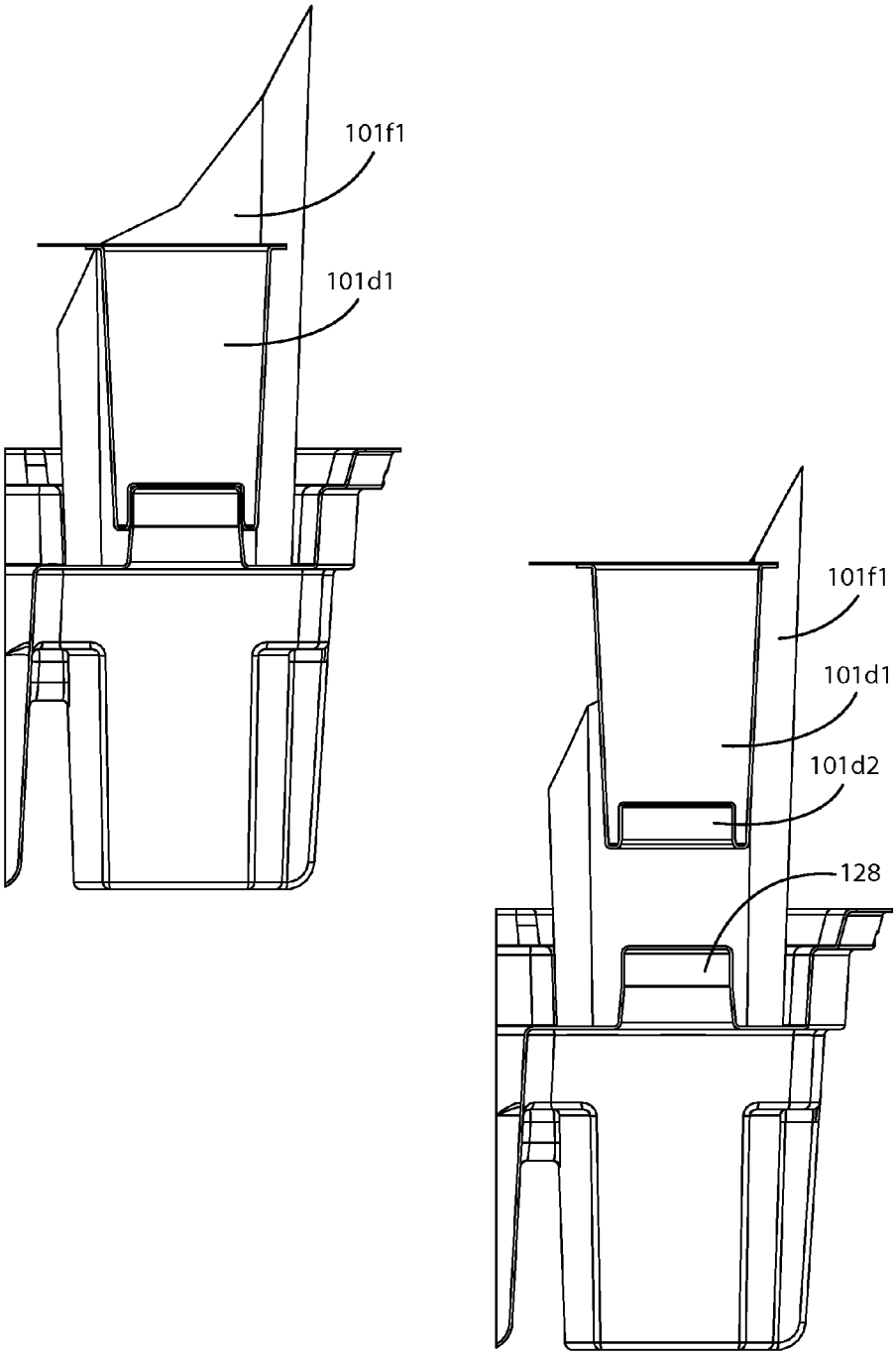
FIG. 9 illustrates a close-up view and exploded perspective view of a dipping cup in the inserted position and removed therefrom.

FIG. 9 illustrates a close-up view and exploded perspective view of a dipping cup in the inserted position and removed therefrom. As shown in FIG. 9, one or more of the solid or liquid items 101*b*1, 101*f*1 and 101*d*1 may include at least one upward recessed cavity 101*d*2, such as a female element or circular upward recessed cavity, oriented upward from a bottom horizontal wall of one or more of the solid or liquid items 101*b*1, 101*f*1 and as shown for example in 101*d*1. In at least one embodiment, the at least one upward recessed cavity 101*d*2 may be of size or shape as required by other embodiments of the invention. By way of one or more embodiments, the at least one upward protruding male circular post 128 may engage with the at least one upward recessed cavity 101*d*2 at the bottom horizontal wall of the respective drop-in container. As such, in at least one embodiment, the at least one upward recessed cavity 101*d*2 may press fit over the at least one upward protruding male circular post 128, respectively. In at least one embodiment, the at least one upward protruding male circular post 128 may be integrated into any portion of the top horizontal wall of the at least one container body 131, such as a back portion or front portion in relation to the user and the straw.

While the invention herein disclosed has been described by means of specific embodiments and applications thereof, numerous modifications and variations could be made thereto by those skilled in the art without departing from the scope of the invention set forth in the claims. Various configurations of the invention have been shown—each containing individual embodiments. For the sake of brevity and to avoid repetition, not all embodiments have been mentioned in every configuration. The embodiments described herein may implement or combine any features from any other embodiment and as such any new configuration/embodiment combination, which arises from embodiments herein, is in keeping with the spirit of the invention.

What is claimed is:

1. A cup with outwardly protruding straw channel and nestable food container comprising:

a food container comprising at least one wall that defines at least one container body configured to store food comprising a first solid or liquid; and, a cup comprising a substantially vertical sidewall comprising a lower cup body, an upper cup body having a portion that is wider than said lower cup body, wherein said portion that is wider in said upper cup body with respect to said lower cup body defines a fill line configured to indicate a volume of beverage to fill said cup, wherein said beverage comprises a second solid or liquid, and, wherein said second solid or liquid is separate from said first solid or liquid stored in said food container;

an outwardly protruding straw channel integrated into said substantially vertical sidewall; and, a recessed opening; and, wherein said at least one container body is configured to descend into said recessed opening of said cup down to said fill line, and, contact said first solid or liquid on one side and said second solid or liquid on an opposing side of said at least one wall.

2. The cup with outwardly protruding straw channel and nestable food container of claim 1, wherein said upper cup body is configured to hold said food container.

3. The cup with outwardly protruding straw channel and nestable food container of claim 1 wherein said at least one wall comprises at least one dividing wall defining a plurality of downward oriented container cavities configured to hold said first solid or liquid.

4. The cup with outwardly protruding straw channel and nestable food container of claim 1, wherein said upper cup body includes an outwardly extending area and wherein said at least one container body further comprises a corresponding outwardly extending area that is configured to enable fingers of a user to access said food in said at least one container body.

5. The cup with outwardly protruding straw channel and nestable food container of claim 1, wherein said food container comprises a plurality of downward oriented cavities, wherein each of said plurality of downward oriented cavities comprises a bottom outer corner portion.

6. The cup with outwardly protruding straw channel and nestable food container of claim 5, wherein one of said plurality of downward oriented cavities is configured to rest on said portion that is wider in said upper cup body with respect to said lower cup body.

7. The cup with outwardly protruding straw channel and nestable food container of claim 1, wherein said food container further comprises at least one cover configured to enclose at least a portion of said food container.

8. The cup with outwardly protruding straw channel and nestable food container of claim 7, wherein said at least one container body further comprises an outer edge vertical receiving wall and snap/bump elements, and said at least one cover comprises a flexible flange/lip at an outer edge of said cover, and wherein said outer edge vertical receiving wall and said snap/bump elements are configured to securely hold said at least one cover closed.

9. The cup with outwardly protruding straw channel and nestable food container of claim 7, wherein said food container and said at least one cover together comprise a one-piece clam shell configuration.

10. The cup with outwardly protruding straw channel and nestable food container of claim 7, wherein said at least one cover comprises at least one vent hole configured to prevent condensation from building up within said at least one cover and said at least one container body.

11. The cup with outwardly protruding straw channel and nestable food container of claim 1, wherein said substantially vertical sidewall of said cup further comprises at least one horizontal step wall or strength rib element integrated into said upper cup body.

12. The cup with outwardly protruding straw channel and nestable food container of claim 1, wherein said at least one container body further comprises at least one horizontal step wall or strength rib element integrated into said substantially vertical sidewall.

13. The cup with outwardly protruding straw channel and nestable food container of claim 7, wherein said at least one cover further comprises at least one horizontal step wall or strength rib element integrated into said substantially vertical sidewall.

14. The cup with outwardly protruding straw channel and nestable food container of claim 1, wherein said at least one container body further comprises at least one upward protruding male post configured to engage a female element in an independent drop-in container.

15. The cup with outwardly protruding straw channel and nestable food container of claim 7, wherein said at least one cover comprises a variable height cover comprising a raised portion configured to hold at least one tall food item.

16. The cup with outwardly protruding straw channel and nestable food container of claim 7, wherein said at least one cover comprises a variable height cover comprising a raised portion configured as a grip handle.

17. The cup with outwardly protruding straw channel and nestable food container of claim 14, wherein said at least one raised portion further comprises a clip/trough element configured to hold at least one item.

18. The cup with outwardly protruding straw channel and nestable food container of claim 7, wherein said at least one cover comprises a flexible flange/lip located at said outer edge.

19. The cup with outwardly protruding straw channel and nestable food container of claim 17, wherein said at least one wall of said food container further comprises at least one male snap/bump element, such that said flexible flange/lip is configured to snap over or past said at least one male snap/bump element.

20. The cup with outwardly protruding straw channel and nestable food container of claim 17, wherein said at least one container body comprises an outer edge lip, and wherein at least one horizontally oriented lift tab is integrated into said outer edge lip of said at least one container body and is configured to facilitate lifting of said at least one container body from said upper cup body.

21. A cup with outwardly protruding straw channel and nestable food container comprising:

a food container comprising at least one wall that defines at least one container body configured to store food comprising a first solid or liquid; and, a cup comprising a substantially vertical sidewall comprising a lower cup body, an upper cup body having a portion that is wider than said lower cup body, wherein said portion that is wider in said upper cup body with respect to said lower cup body defines a fill line configured to indicate a volume of beverage to fill said cup, wherein said beverage comprises a second solid or liquid, and, wherein said second solid or liquid is separate from said first solid or liquid stored in said food container;

an outwardly protruding straw channel integrated into said substantially vertical sidewall; and, a recessed opening;

wherein said at least one container body is configured to contact said first solid or liquid on one side and said second solid or liquid on an opposing side of said at least one wall;

wherein said food container comprises a plurality of downward oriented cavities, wherein each of said plurality of downward oriented cavities comprises a bottom outer corner portion; and, wherein one of said plurality of downward oriented cavities is configured to rest on said portion that is wider in said upper cup body with respect to said lower cup body.

22. A cup with outwardly protruding straw channel and nestable food container comprising:

a food container comprising at least one wall that defines at least one container body configured to store food comprising a first solid or liquid, and, at least one cover configured to enclose at least a portion of said food container, wherein said at least one container body further comprises an outer edge vertical receiving wall and snap/bump elements, wherein said at least one cover comprises a flexible flange/lip at an outer edge of said cover, and, wherein said outer edge vertical receiving wall and said snap/bump elements are configured to securely hold said at least one cover closed; and, a cup comprising a substantially vertical sidewall comprising a lower cup body, an upper cup body having a portion that is wider than said lower cup body, wherein said portion that is wider in said upper cup body with respect to said lower cup body defines a fill line configured to indicate a volume of beverage to fill said cup, wherein said beverage comprises a second solid or liquid, and, wherein said second solid or liquid is separate from said first solid or liquid stored in said food container;

an outwardly protruding straw channel integrated into said substantially vertical sidewall; and, a recessed opening; and, wherein said at least one container body is configured to contact said first solid or liquid on one side and said second solid or liquid on an opposing side of said at least one wall.

23. A cup with outwardly protruding straw channel and nestable food container comprising:

a food container comprising at least one wall that defines at least one container body configured to store food comprising a first solid or liquid, and, at least one cover configured to enclose at least a portion of said food container, wherein said at least one cover comprises at least one vent hole configured to prevent condensation from building up within said at least one cover and said at least one container body; and, a cup comprising a substantially vertical sidewall comprising a lower cup body, an upper cup body having a portion that is wider than said lower cup body, wherein said portion that is wider in said upper cup body with respect to said lower cup body defines a fill line configured to indicate a volume of beverage to fill said cup, wherein said beverage comprises a second solid or liquid, and, wherein said second solid or liquid is separate from said first solid or liquid stored in said food container;

an outwardly protruding straw channel integrated into said substantially vertical sidewall; and, a recessed opening; and, wherein said at least one container body is configured to contact said first solid or liquid on one side and said second solid or liquid on an opposing side of said at least one wall.

24. A cup with outwardly protruding straw channel and nestable food container comprising:

a food container comprising at least one wall that defines at least one container body configured to store food comprising a first solid or liquid, wherein said at least one container body further comprises at least one upward protruding male post configured to engage a female element in an independent drop-in container; and, a cup comprising a substantially vertical sidewall comprising a lower cup body, an upper cup body having a portion that is wider than said lower cup body, wherein said portion that is wider in said upper cup body with respect to said lower cup body defines a fill line configured to indicate a volume of beverage to fill said cup, wherein said beverage comprises a second solid or liquid, and, wherein said second solid or liquid is separate from said first solid or liquid stored in said food container;

an outwardly protruding straw channel integrated into said substantially vertical sidewall; and, a recessed opening; and, wherein said at least one container body is configured to contact said first solid or liquid on one side and said second solid or liquid on an opposing side of said at least one wall.

25. A cup with outwardly protruding straw channel and nestable food container comprising:

a food container comprising at least one wall that defines at least one container body configured to store food comprising a first solid or liquid, wherein said food container further comprises at least one cover configured to enclose at least a portion of said food container, and, wherein said at least one cover comprises a flexible flange/lip located at said outer edge; and, a cup comprising a substantially vertical sidewall comprising a lower cup body, an upper cup body having a portion that is wider than said lower cup body, wherein said portion that is wider in said upper cup body with respect to said lower cup body defines a fill line configured to indicate a volume of beverage to fill said cup, wherein said beverage comprises a second solid or liquid, and, wherein said second solid or liquid is separate from said first solid or liquid stored in said food container;

an outwardly protruding straw channel integrated into said substantially vertical sidewall; and, a recessed opening; and, wherein said at least one container body is configured to contact said first solid or liquid on one side and said second solid or liquid on an opposing side of said at least one wall.

26. The cup with outwardly protruding straw channel and nestable food container of claim 25, wherein said at least one wall of said food container further comprises at least one male snap/bump element, such that said flexible flange/lip is configured to snap over or past said at least one male snap/bump element.

27. The cup with outwardly protruding straw channel and nestable food container of claim 25, wherein said at least one container body comprises an outer edge lip, and wherein at least one horizontally oriented lift tab is integrated into said outer edge lip of said at least one container body and is configured to facilitate lifting of said at least one container body from said upper cup body.

* * * * *